US006698535B1

(12) United States Patent
Morris et al.

(10) Patent No.: US 6,698,535 B1
(45) Date of Patent: Mar. 2, 2004

(54) FLOATING OFFSET TRANSMITTER HOUSING UNDERGROUND DIRECTIONAL DRILLING TOOL

(76) Inventors: Waldo Morris, 4512 Lakeside Rd., Marion, IA (US) 52302; Bruce Heims, 1138 Linn Delaware Rd., Coggon, IA (US) 52218

( * ) Notice: Subject to any disclaimer, the term of this patent is extended or adjusted under 35 U.S.C. 154(b) by 0 days.

(21) Appl. No.: 10/063,499

(22) Filed: Apr. 30, 2002

(51) Int. Cl.[7] ..... E21B 7/06
(52) U.S. Cl. ..... 175/45; 175/73
(58) Field of Search ..... 175/45, 73, 76

(56) References Cited

U.S. PATENT DOCUMENTS

| | | | |
|---|---|---|---|
| 3,363,704 A | | 1/1968 | Farris et al. |
| 3,746,106 A | | 7/1973 | McCullough et al. |
| RE28,625 E | | 11/1975 | Cunningham |
| 3,997,008 A | | 12/1976 | Kellner |
| 4,040,495 A | | 8/1977 | Kellner et al. |
| 4,076,084 A | | 2/1978 | Tighe |
| 4,220,214 A | | 9/1980 | Benoit |
| 4,407,374 A | | 10/1983 | Wallussek et al. |
| 4,422,823 A | | 12/1983 | Ioannesian et al. |
| 4,560,014 A | | 12/1985 | Geczy |
| 4,597,454 A | | 7/1986 | Schoeffler |
| 4,732,223 A | | 3/1988 | Schoeffler et al. |
| 4,811,798 A | | 3/1989 | Falgout, Sr. et al. |
| 4,880,067 A | | 11/1989 | Jelsma |
| 5,000,272 A | | 3/1991 | Wiebe et al. |
| RE33,660 E | | 8/1991 | Jelsma |
| 5,267,741 A | | 12/1993 | Leitner |
| 5,341,886 A | | 8/1994 | Patton |
| 5,449,046 A | | 9/1995 | Kinnan |
| 5,484,029 A | | 1/1996 | Eddison |
| 5,490,569 A | | 2/1996 | Brotherton et al. |
| 5,520,256 A | | 5/1996 | Eddison |
| 5,529,133 A | | 6/1996 | Eddison |
| 5,547,031 A | | 8/1996 | Warren et al. |
| RE36,166 E | * | 3/1999 | Johns et al. ..... 175/61 |
| 6,050,350 A | | 4/2000 | Morris et al. |

* cited by examiner

*Primary Examiner*—William Neuder
(74) *Attorney, Agent, or Firm*—Glenn Johnson

(57) ABSTRACT

The subject matter of this invention is an underground directional drilling tool which is particularly effective in drilling rock and highly compacted soil formations. This tool is an improvement upon the tool developed by Applicants and patented in U.S. Pat. No. 6,050,350. The current invention utilizes ball bearings contained within subassemblies positioned at each end of the steering tool. This allows the steering tool to float upon the subassemblies as the inner core and drive shaft rotate within the subassemblies and steering tool, thereby reducing rotational torque transfer from the drill string, subassemblies and drive shaft to the housing of the directional drilling tool. The use of the ball bearing containing subassemblies improves underground stability and, thus, steerability during the forward drilling operation. Further, these improved features reduce wear thereby increasing durability of the tool which is used in the harsh underground environment.

9 Claims, 9 Drawing Sheets

SECTION A-A

SECTION B-B

FLOATING OFFSET TRANSMITTER HOUSING UNDERGROUND DIRECTIONAL DRILLING TOOL

BACKGROUND OF INVENTION

The use of directional horizontal underground drilling has become increasingly effective and more widely accepted for the installation of water and gas pipes, underground utilities, telephone lines, and cables. Prior to the use of these horizontal drilling techniques, open trenches were generally required to place pipes, cables and wires underground. With such trenches, particular difficulties were encountered in crossing bodies of water, roads, driveways, improved areas, or existing underground utility installations. Accordingly, horizontal directional drilling techniques have allowed for the elimination of open trenches in many situations, particularly when encountering obstacles at or near the surface.

With the development of these horizontal drilling techniques, there has been an historic need to develop a more precise and cost effective system to effectively control the route of travel, depth of travel, and point of emergence for the drilling apparatus. In response to these needs, a drill radio-transmitting unit was developed and incorporated into the underground directional drilling apparatus to broadcast a remote signal to aid in identifying the direction of travel, depth of the drilling apparatus, orientation within the borehole of the drilling apparatus, and inclination of the drilling apparatus. The development of drill transmitting units, in turn, created a demand for resilient housing to contain and protect transmitting equipment which was located near the leading or cutting end of an underground directional drilling tool. Further, greater demand was created for more precise directional control of the boring operation.

When in use, the area of underground drilling is an extremely hostile environment. As such, a desirable underground directional drilling tool should be sufficiently durable to operate within this hostile environment over an extended period of use and an extended product life. Additionally, there remains a continuing need to improve the efficiency of the tool in stabilizing, positioning and controlling the drill bit in downhole operations. It is therefore an object of the present invention to provide a tool for use with directional drills, which tool is efficient in stabilizing, positioning and controlling the direction, depth, orientation and inclination of the drilling operation.

The applicant has previously developed and patented an improved underground directional drilling tool having an improved method for control. As discussed in the inventor's U.S. Pat. No. 6,050,350, which is incorporated herein by reference, there has been and continues to be a need for durable, steerable underground drilling apparatus of simple construction. Simple construction is important to allow for ease of repair, reduction of downtime associated with repair, and minimization of repeated removal of the apparatus from the down hole work area in order to implement repairs. The '350 patent describes an underground directional drilling tool wherein the drive shaft is offset from the centerline of a transmitter housing thus causing the rotation of the drill bit to cut an arcuate path. An overall travel path that is generally straight or that lies in a generally desired route may be formed through periodic rotation of the tool housing, thus changing the immediate arcuate path. As explained in the '350 patent, this design includes a jaw clutch and simple engagement of the housing when the drill string is pulled back. When the housing is so engaged, it may be conveniently rotated through manipulation of the drill string. In this manner, the invention of the '350 patent provides for a simple, reliable, and durable construction that eliminates the need for complex steering devices, motors, and controls. The invention of the '350 patent therefore serves the objective not only of providing a resilient transmitter housing, but it provides a multi-purpose tool that effectively accomplished the objectives of simplicity, durability, and longevity that are important in the hostile, underground environment. The tool also provides a method for steering the tool. In order to pass the torque of the drill string through the tool housing to the drill bit, the '350 housing incorporates a cylindrical bearing in each end of the housing and a cylindrical thrust bearing at the rear. In the '350 housing, the cylindrical thrust bearing and cylindrical bearings carry rotational torque from the driveshaft to the transmitter housing. This creates significant wear on the bearings requiring frequent maintenance and replacement. Further, the rotational torque carried by these bearings to the tool housing creates instability in downhole use that makes directional control more difficult.

The present invention, generally referred to herein as the underground directional drilling tool, seeks to improve in these areas by maintaining simplicity in design, while eliminating the cylindrical bearings in each end of the housing and, further, eliminating the thrust bearing positioned at the rear of the housing. As with the invention of the '350 patent, the housing is offset from the centerline of the drill bit. The new design represented by the present invention reduces the rotational torque transferred from the drive shaft to the offset transmitter housing. Effective use of subassembly bearings allows the drive shaft and rotational components of the subassemblies to operate independently of the direction-controlling, offset transmitter housing as the offset transmitter housing floats on the non-rotating outer sleeve of the subassemblies. It is therefore an object of the present invention to eliminate the bearings in each end of the offset transmitter housing and eliminate the cylindrical thrust bearing that pushes the offset transmitter housing by positioning bearings in the subassemblies located at each end of the housing. These subassemblies are threadably connected to each end of the drive shaft passing through the offset transmitter housing. The housing then floats on the non-rotating outer sleeve of each of the subassemblies independent from the rotating drive shaft.

SUMMARY OF INVENTION

The underground directional drilling tool includes-a rear subassembly and a front subassembly that allow an offset transmitter housing to float on the non-rotating outer sleeves of each of the subassemblies without the use of bearings in or on the housing. Rather, the subassemblies are composite elements. Rear radial bearings and radial thrust bearings are constrained between the rear inner core and the rear outer sleeve of the rear subassembly. This eliminates the cylindrical bearings and cylindrical thrust bearings that were subjected to high wear. Also, the rear subassembly accommodates the drill string and the drive shaft, and provides for the transmission of drilling fluid and torque there between while maintaining a non-rotating rear outer sleeve for advancing the housing as the drilling progresses. Since the rear outer sleeve does not rotate as it advances the offset transmitter housing, it does not transfer significant torque to the housing.

The front subassembly includes a front inner core having a jaw clutch, which core is adapted to couple the drive shaft and a drill bit. Forward radial bearings are constrained between the front inner core and a front outer sleeve to, again, provide a front subassembly with an outer sleeve that is rotationally independent of the drive shaft and that is able to engage and disengage the offset transmitter housing. In both subassemblies, the bearings are better sealed and longer wearing as compared to the use of thrust bearings or cylindrical bearings positioned directly upon the offset transmitter housing in the tool represented by the '350 patent.

The offset transmitter housing has a seal affixed to the front and a seal affixed to the rear that slide over the exterior of the front and rear subassemblies to prevent drill cuttings and other debris from entering the tool. Longitudinal manipulation of the drill string may be used to engage and disengage the jaw clutch.

DETAILED DESCRIPTION

Figure 1:
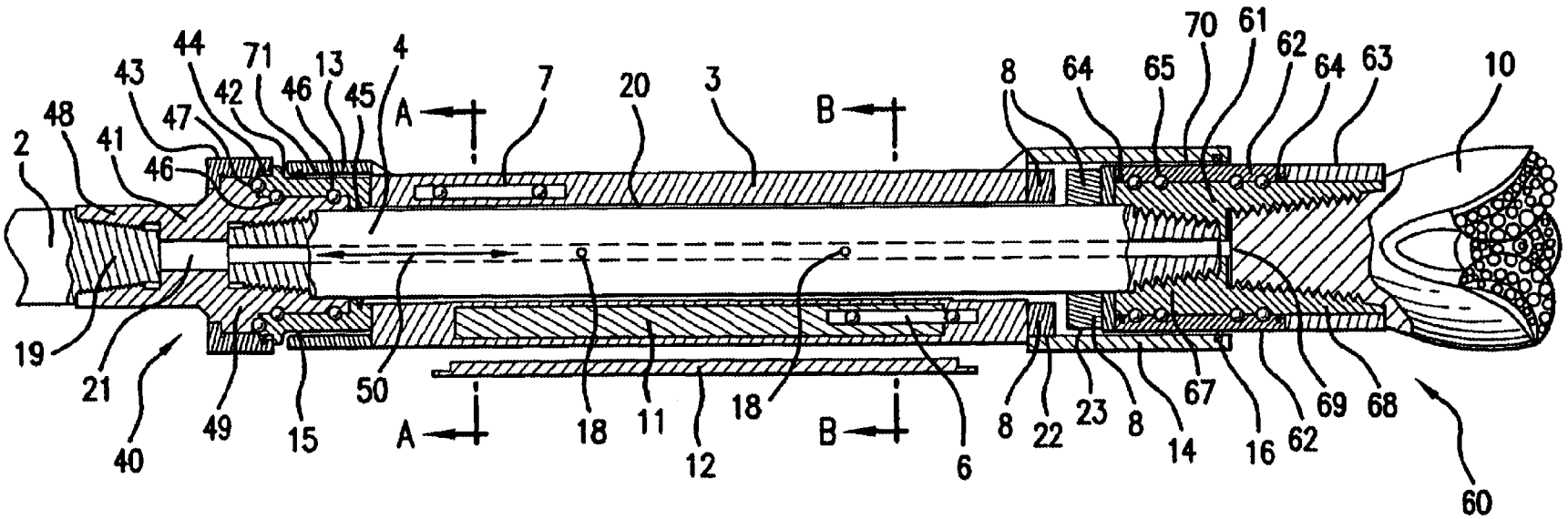
FIG. 1 is a cut-away side perspective view of the underground directional drilling tool.
Figure 2:
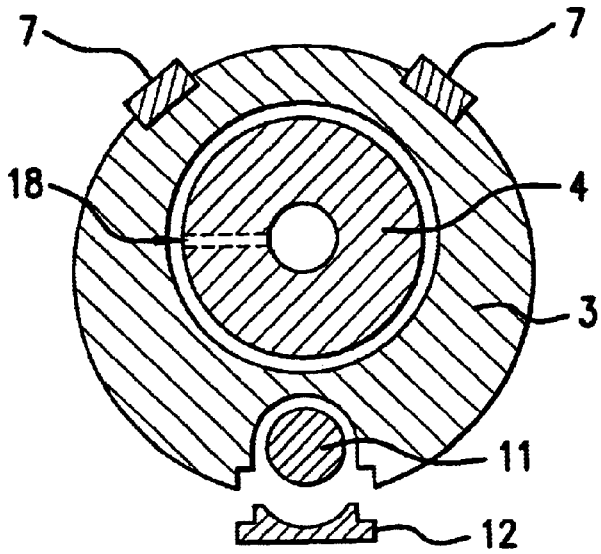
FIG. 2 is a cross-section view of the line AA in FIG. 1.
Figure 3:
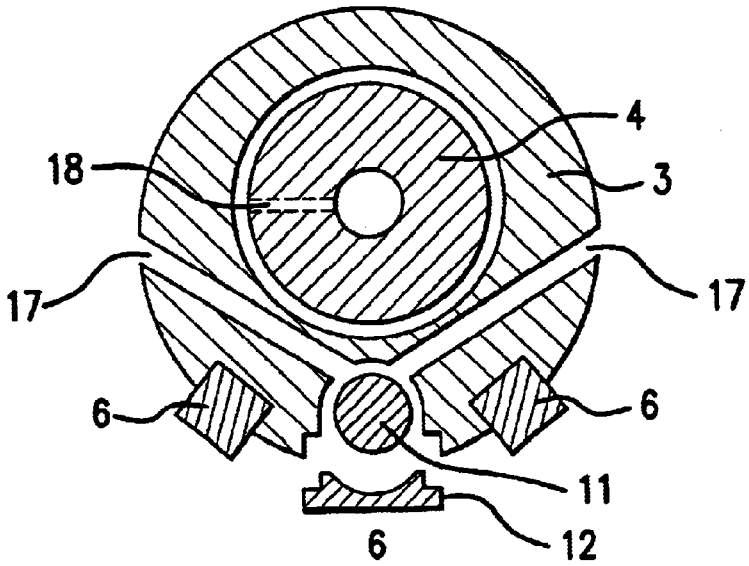
FIG. 3 is a cross-section view of the line BB in FIG. 1.

In its preferred embodiment, and referring first to FIG. 1, the present invention, an underground directional drilling tool, is comprised of a drive shaft 4, a offset transmitter housing 3, a rear subassembly 40, and a front subassembly 60. The drill string 2 runs from the surface power unit down hole to the underground directional drilling tool 1. The drill string 2 is generally hollow and rotatable, and delivers torque and drilling fluid to the down hole operation. The drill string 2 connects to the rear subassembly 40 which, in turn, is connected to the drive shaft 4 passing through the offset transmitter housing 3. The drive shaft 4 is next connected to the front subassembly 60 which, in turn, is connected to the drill bit 10. The rotational energy is transferred from drill string 2 through the offset transmitter housing 3 by way of the drive shaft 4 to the drill bit 10 to allow for down hole drilling operations.

More specifically, the drill string coupling 48 connects the drill string 2 to the rear subassembly 40. The drill string 2 has a forward end 19, preferably threaded, that enters a rear inner core 41 of the rear subassembly 40 and engages, preferably through threaded engagement, the rear drill string coupling 48 of the rear subassembly 40. The rear inner core 41 of the rear subassembly 40 has a rear drive shaft coupling 49 that contains a forward facing enlarged cavity to engage the drive shaft 4 rearward end. Although threaded engagement is preferred, the engagement of the drill string 2 and the drive shaft 4 may be by any convenient means that will allow secure connection of these elements and transmission of torque between the drill string 2 to the drive shaft 4. Finally, the rear inner core 41 has a central cavity 21 formed therein that is adapted to allow the transmission of drilling fluid between the drill string 2 and the drilling fluid passageway 50 of the drive shaft 4. The front of the drive shaft 4 connects to the front inner core 61, preferably by means of threadable engagement, by way of the front drive shaft coupling 67. The drill bit 10 preferably threadably engages the drill bit coupling 68 positioned at the front of the front inner core 61. Like the rear inner core 41, the front inner core has a central cavity 69 formed therein that is adapted to allow the transmission of drilling fluid between the drilling fluid passageway 50 of the drive shaft 4 and the drill bit 10.

The drive shaft 4 is a longitudinally extended member that is housed in an off-center, longitudinal cavity 20 that is formed within the offset transmitter housing 3. As explained generally in the '350 patent, and as utilized in the current invention and explained herein, an offset transmitter housing 3 provides a variety of functions to the underground directional drilling tool 1. First, it houses the transmitter 11, which sends information to the operator pertaining to the direction, depth, orientation, and inclination of the underground directional drilling tool as the down hole drilling operations progress. Secondly, and as explained in the '350 patent, affixed to the exterior of the offset transmitter housing 3 are front stabilizing fins 6 and rear stabilizing fins 7 that function to provide frictional surface areas to prevent the unwanted rotation of the offset transmitter housing 3 and to hold the offset transmitter housing 3 in a stable orientation within the borehole, thus steering the direction of the forward drilling operation. In the present invention, the subassemblies 40, 60 serve to minimize rotational torque to the offset transmitter housing 3 due to the rear outer sleeve 42 and the front outer sleeve 62 remaining stationary in relation to the offset transmitter housing 3. Through relocation of the bearing-housing function from the offset transmitter housing 3 to the subassemblies 40, 60, as explained more fully below, the offset transmitter housing 3 is floating on the rear outer sleeve 42 and the front outer sleeve 62 and is less prone to rotation.

The drive shaft 4 may be solid and inflexible. In the preferred embodiment, however, it has a hollow interior forming the drilling fluid passageway 50, while still maintaining sufficient stiffness to resist flexion or bowing during forward drilling operations. The drilling fluid passageway 50 carries pressurized drilling fluid. Small fluid holes 18 placed in the drive shaft 4 extend to the drilling fluid passageway 50 and allow for the escape of drilling fluid into the drive shaft cavity 20. This drilling fluid functions to cool, lubricate, and flush the annular space within the drive shaft cavity 20 that separates the drive shaft 4 and the interior of the offset transmitter housing 3, and to provide a continuous washing action to remove debris from the area of the drive shaft 4, and jaw clutch 8.

Although preferred to be generally circular in nature, the wide side of the offset transmitter housing 3 retains a cover plate 12 closing off the cavity in which the transmitter 11 is housed, and the narrow side of the offset transmitter housing 3 is the side nearest to the drive shaft 4 passing through it. The function of the transmitter 11 is to transmit information to the operator on the position, direction, orientation and inclination of the underground directional drilling tool 1. This information is used by the operator to steer the forward drilling operation. Other forms of sending units may be used which include transmission means by way of wires running from the surface to the offset transmitter housing 3. The cover plate 12 retaining the transmitter within the cavity in the side of the offset transmitter housing 3 in conjunction with the transmitter windows 17 allows the signal to readily pass through the offset transmitter housing 3 to be received at the surface.

Stabilizer fins 6 are located on the side wall furthest from the drive shaft 4 near the front of the offset transmitter housing 3, and stabilizing fins 7 are also located on the opposing side wall of the offset transmitter housing 3 near the rear. The stabilizing fins 6, 7, operate to center the offset transmitter housing 3 in the borehole and provide a ready pathway for the flow of drilling fluid and cutting debris past the underground directional drilling tool 1. The cutting debris and the drilling fluid that flows past the stabilizing fins 6, 7, operate to provide a medium with additional frictional resistance to prevent unwanted rotation of the offset transmitter housing 3, thereby maintaining the offset transmitter housing 3 in a stable position. This stable position is maintained even when drilling through solid rock. Use of the rear stabilizing fins 7 is preferred to assist in centering the offset transmitter housing 3 within the borehole, and helping to maintain the offset transmitter housing 3 in a stable position.

The front subassembly 60 of the underground directional drilling tool 1 in combination with the rear subassembly 40 allow the offset transmitter housing 3 to "float" on the rear outer sleeve 42 and the front outer sleeve 62. This floating positioning aides in the stabilization of the offset transmitter housing 3 through elimination of the positioning of bearings within and against the offset transmitter housing 3. In prior versions of this tool, the bearings positioned within and against the offset transmitter housing 3 transferred larger amounts of rotational torque to the offset transmitter housing 3 thereby causing the offset transmitter housing 3 to rotate. This new invention allows the rear outer sleeve 42 to remain stationary against the rear seal 15, and the front outer sleeve 62 to remain stationary against the front seal 14 while the drive shaft 4 rotates. The offset transmitter housing 3 thereby "floats" while drilling and shifting operations are in progress.

The offset nature of the drive shaft 4 passing through the offset transmitter housing 3 operates to position the drill bit 10 above the centerline of the offset transmitter housing 3. As long as the offset transmitter housing 3 remains stationary down hole, the drill bit 10 will cut a pathway with a constant curvature away from the wide side of the offset transmitter housing 3. The orientation of the underground directional drilling tool is accomplished by use of jaw clutch 8 at the connection between the offset transmitter housing 3 and front subassembly 60. The jaw clutch 8 utilizes a plurality of teeth and notches. When forward thrust is applied, the jaw clutch 8 is disengaged by the drive shaft 4 sliding forward through the offset transmitter housing 3 until the rear outer sleeve 42 of the rear subassembly 40 comes into contact with the back of the offset transmitter housing 3. This allows the front inner core 61 and the fixed sleeve 63 of the front subassembly 60, and the attached drill bit 10, to spin freely without the transfer of significant rotational torque to the offset transmitter housing 3, thus allowing the housing to be rotationally independent of the drive shaft 4 when the jaw clutch 8 is disengaged.

In order to steer or alter the course of the drill head, the operator merely pulls back on the drill string 2 a short distance so as to engage the jaw clutch 8 and thereby expose the housing to torque transfer from the drill string 2 through the drive shaft 4. The jaw clutch 8 is comprised of a rearward segment 22 and a forward segment 23. Each segment 22, 23 of the jaw clutch 8 is beveled to facilitate engagement and allow for the ready removal of cuttings and debris from the engaging surfaces. After engagement of the rearward segment 22 and the forward segment 23 of the jaw clutch 8, the operator rotates the drill string 2 the desired number of degrees so as to reposition the offset transmitter housing 3 within the hole. In this fashion the operator may turn the pathway of drilling in any direction without the need of an external steering sleeve or complex mechanism to cam the drill head. This affords the operator the ability to make quick and precise alterations in the direction of the drilling pathway.

Figure 4:
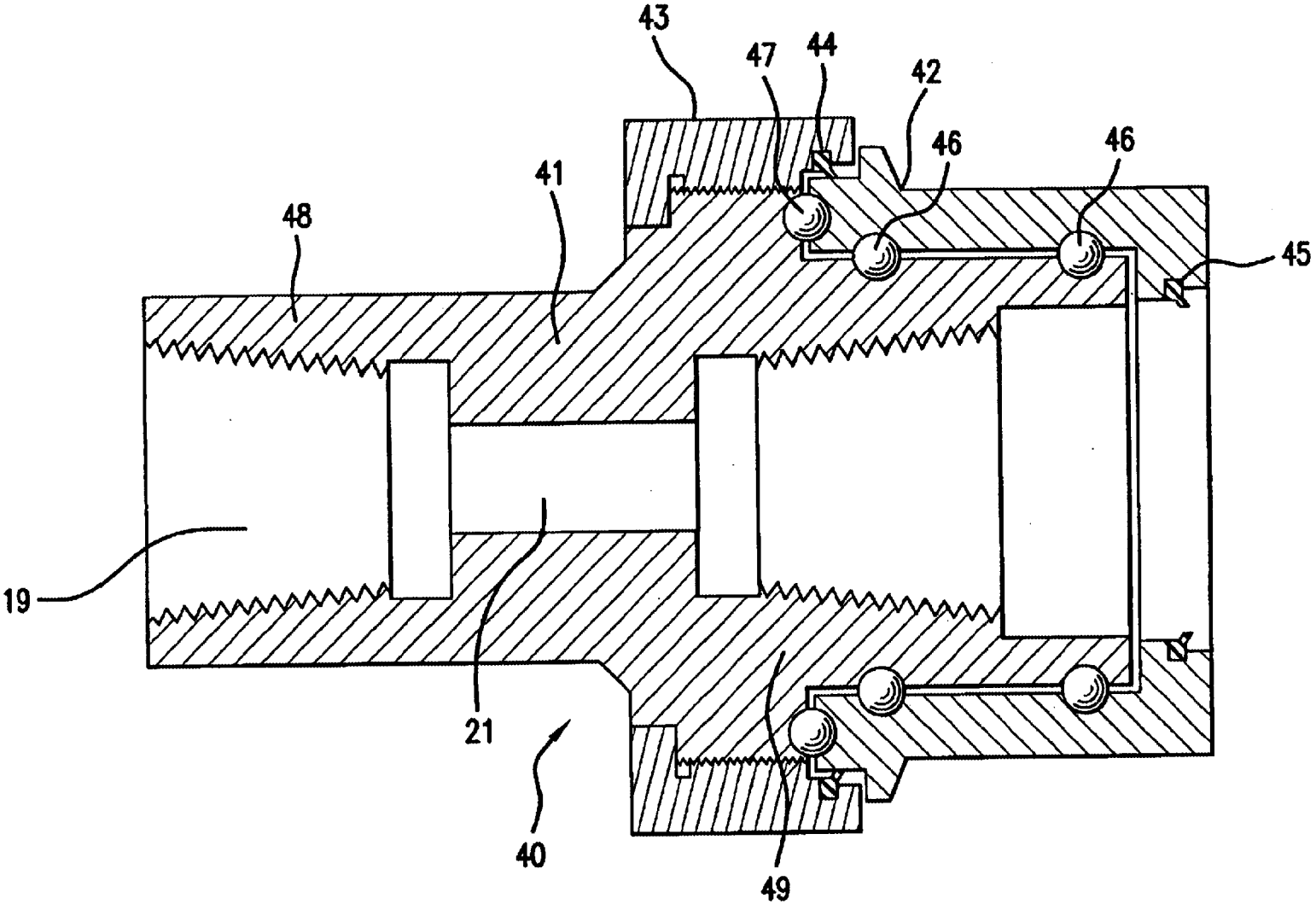
FIG. 4 is a cut-away view of the rear subassembly.
Figure 5:
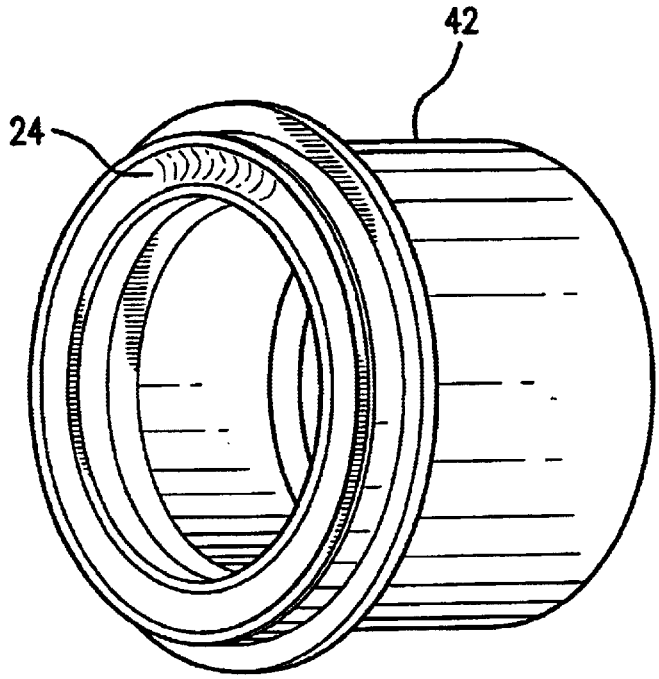
FIG. 5 is an angled side view of the rear outer sleeve.
Figure 6:
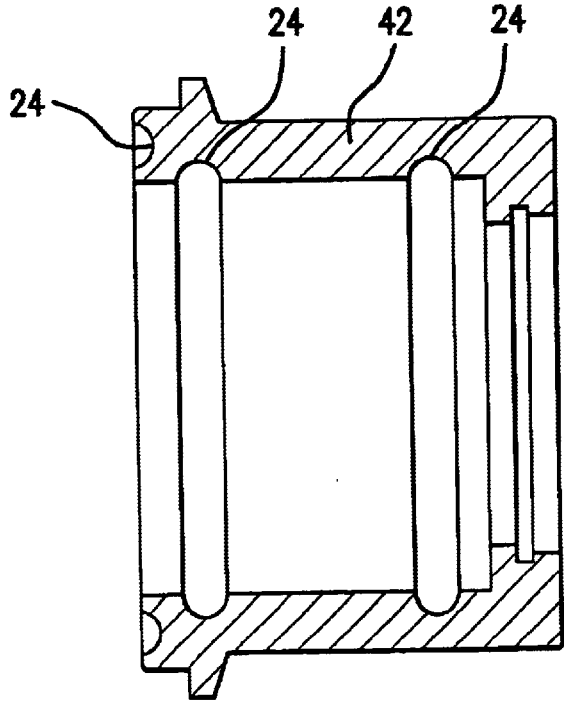
FIG. 6 is a cut-away view of the rear outer sleeve.
Figure 7:
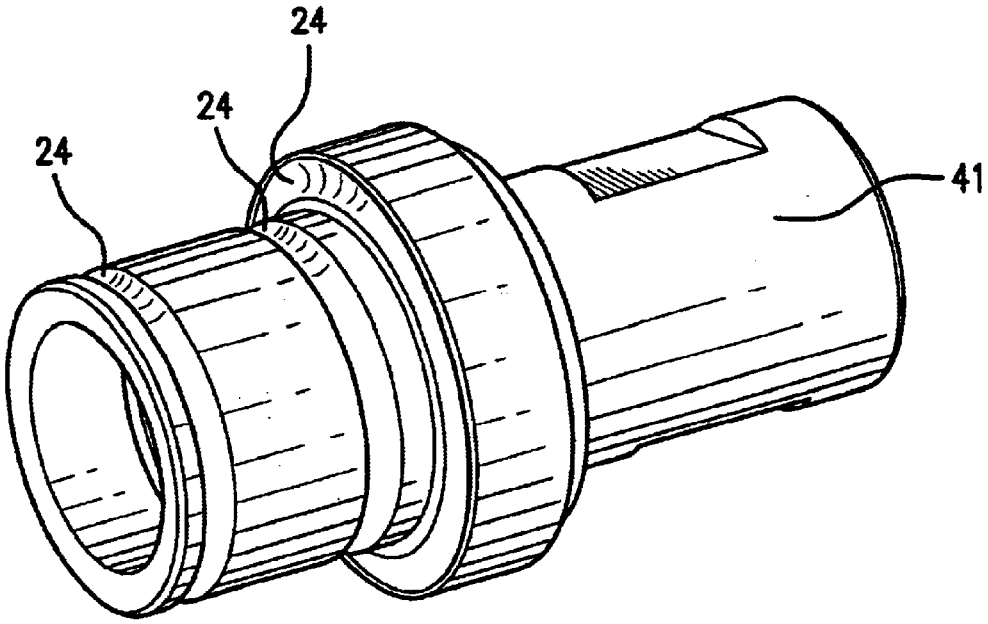
FIG. 7 is an angled side view of the rear inner core.
Figure 8:
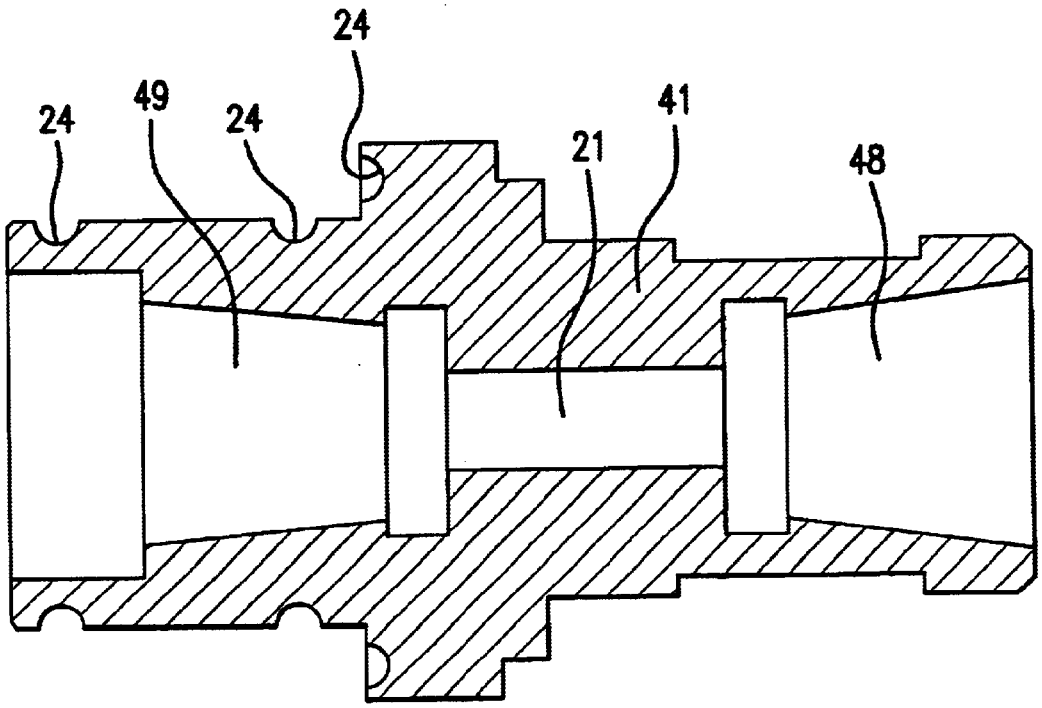
FIG. 8 is a cut-away view of the rear inner core.
Figure 9:
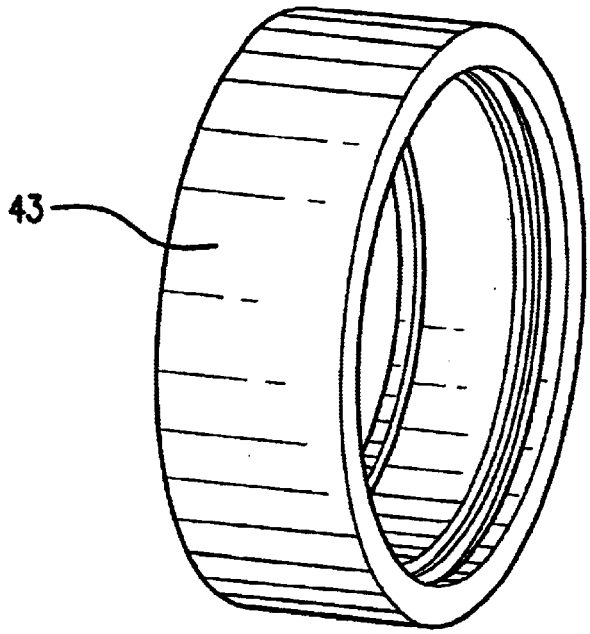
FIG. 9 is an angled side view of the rear seal nut.
Figure 10:
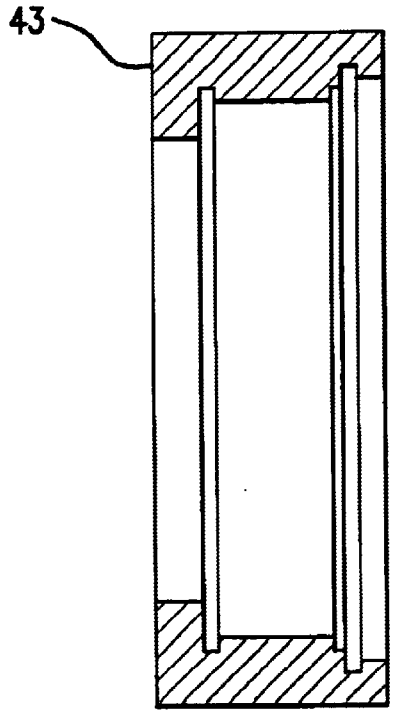
FIG. 10 is a cut-away view of the rear seal nut.

The preferred rear subassembly 40 is illustrated in FIG. 4, with the preferred components thereof illustrated in FIG. 5 through 10. The rear subassembly 40 is comprised of a rear outer sleeve 42, a rear inner core 41, and a rear seal nut 43. In the preferred embodiment the rear seal nut 43 is threadably engaged to the exterior of the rear inner core 41, which threadable connection facilitates disassembly in the event of the need for maintenance. As shown in cut-away fashion by FIG. 4, the rear outer sleeve 42 and rear inner core 41 are mated so that the rear inner core 41 rotates inside the rear outer sleeve 42 on a plurality of radial bearings 46 positioned within bearing races 24 located within the outer wall of the rear inner core 41 and the inner wall of the rear outer sleeve 42. In the preferred embodiment, ball bearings are employed for both the radial bearings 46 and radial thrust bearings 47. In this manner, when the drill string 2 is threadably engaged in the drill string coupling 48 of the rear subassembly 40, rotation of the drill string 2 causes the rear inner core 41 to rotate upon the bearings 46, 47 held between the rear inner core 41 and the rear outer sleeve 42, thus allowing the rear outer sleeve 42 to remain stationary. In the preferred embodiment, grease fittings are provided in the rear subassembly 40 to allow lubrication of the bearings 46, 47 and the annular space that exists between the components of the rear subassembly 40. Also, located on the forward portion of the interior wall of the rear seal nut 43 is the nut seal 44, while the rear driveshaft seal 45 is located on the forward portion of the interior wall of the rear outer sleeve 42. The nut seal 44 and the rear driveshaft seal 45 operate to prevent the infusion of drilling fluid and debris into the bearing races 24. In further examination of FIG. 1, it may be observed that the rear portion of the offset transmitter housing 3 has a rear seal cover 13 which is a circumferential cover into which the rear outer sleeve 42 of the rear subassembly 40 is positioned. The rear seal cover 13 is affixed to the rear of the offset transmitter housing 3. This is usually accomplished by either machining the rear seal cover 13 as an integral part of the offset transmitter housing 3 or by having the rear seal cover 13 made separately and affixed by welding or bolting the rear seal cover 13 into position at the rear of the offset transmitter housing 3. The welding method is preferred for ease of manufacture. Near the rearward inner wall of the rear seal cover 13 is positioned the rear seal 15. The rear seal 15 is made of elastic material of sufficient stiffness so as to frictionally prevent undesired rotation of the rear outer sleeve 42 during actual downhole drilling operations, and it also serves to prevent cuttings and debris from entering into the drive shaft cavity 20. Small amounts of unwanted rotational torque play upon the rear outer sleeve 42 as a result of its contact with the bearing assemblies 46, 47, the nut seal 44, and the rear driveshaft seal 45. In actual operation, when the operator retracts the drill string 2 to engage the jaw clutch 8 for purposes of orienting or reorienting the offset transmitter housing 3, the forward portion of the rear outer sleeve 42 does not pass rearwardly past the location of the rear seal 15. When forward drilling is progressing, the rear outer sleeve 42 remains stationary and is positioned approximately as shown in FIG. 1, and the forward portion of the rear outer sleeve 42 pushes the offset transmitter housing 3 forward as drilling progresses. As forward drilling operations proceed, the primary forward thrust is transferred directly from the drill string 2 to the drive shaft 4 by way of the drill string coupling 48.

Figure 11:
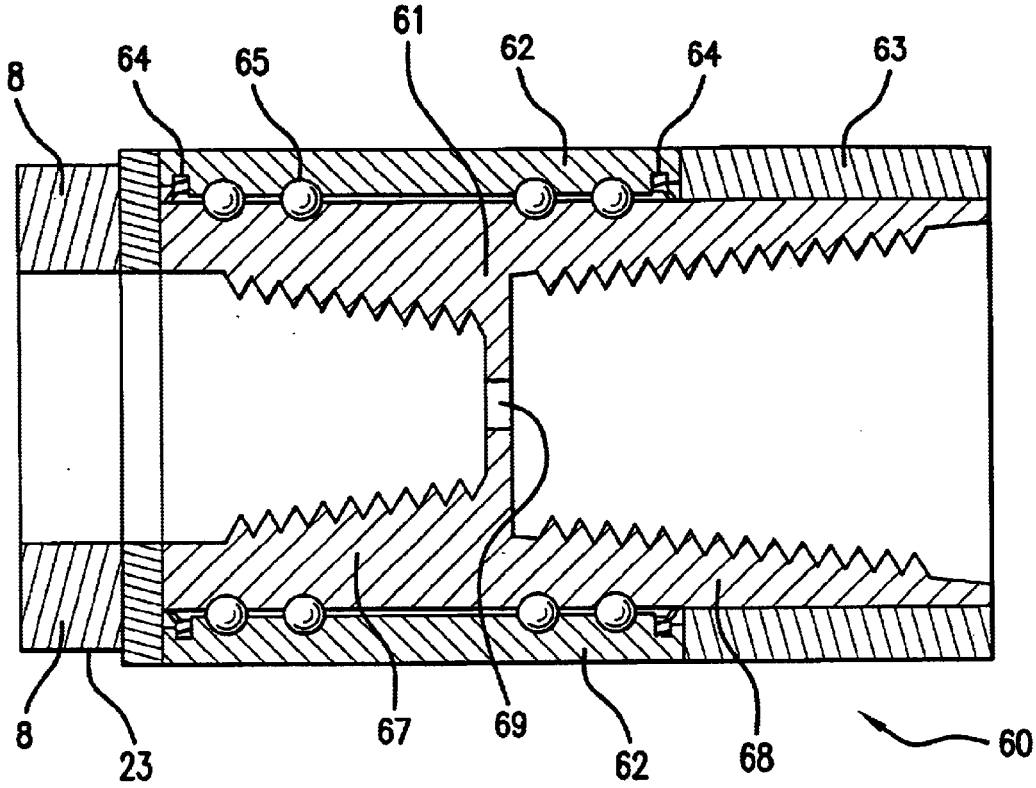
FIG. 11 is a cut-away view of the front subassembly.
Figure 12:
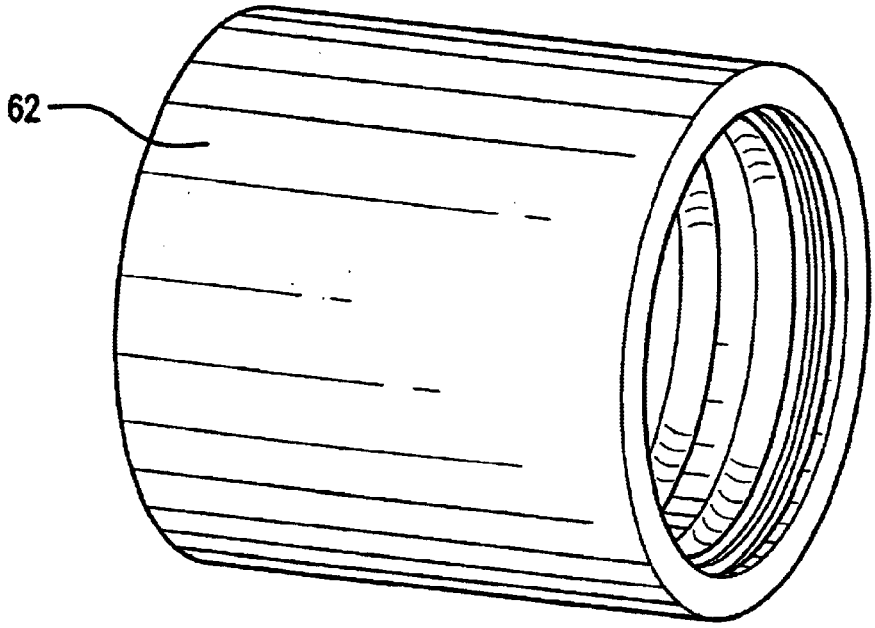
FIG. 12 is an angled side view of the front outer sleeve.
Figure 13:
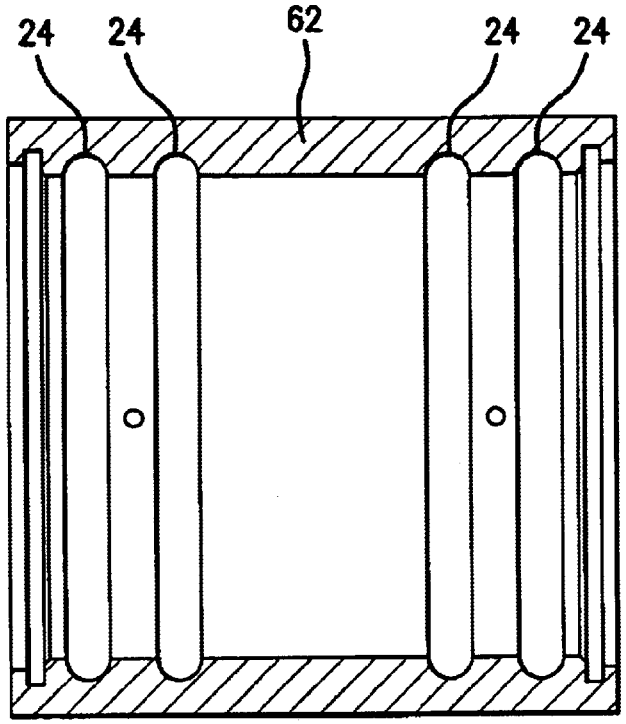
FIG. 13 is a cut-away view of the front outer sleeve.
Figure 14:
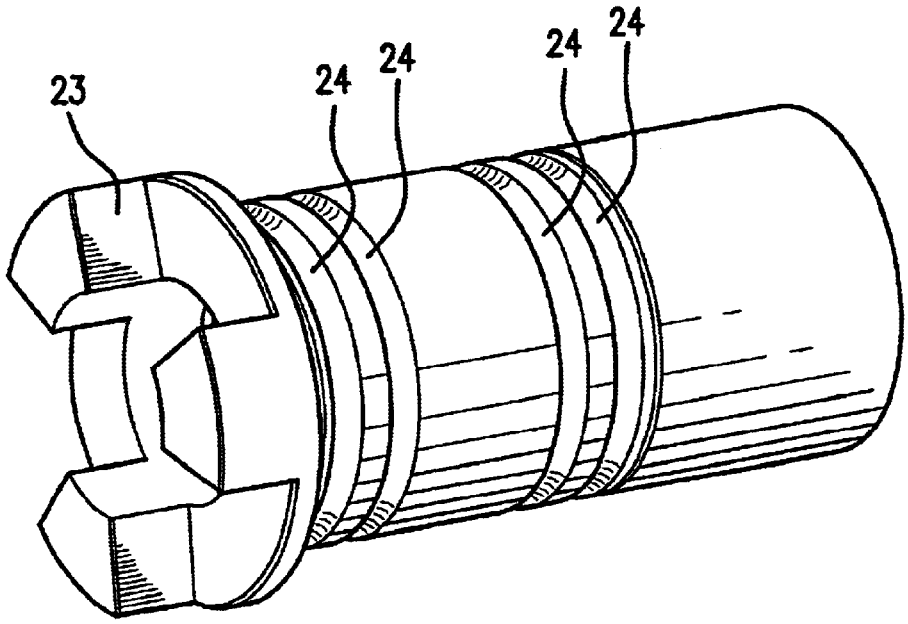
FIG. 14 is an angled side view of the front inner core.
Figure 15:
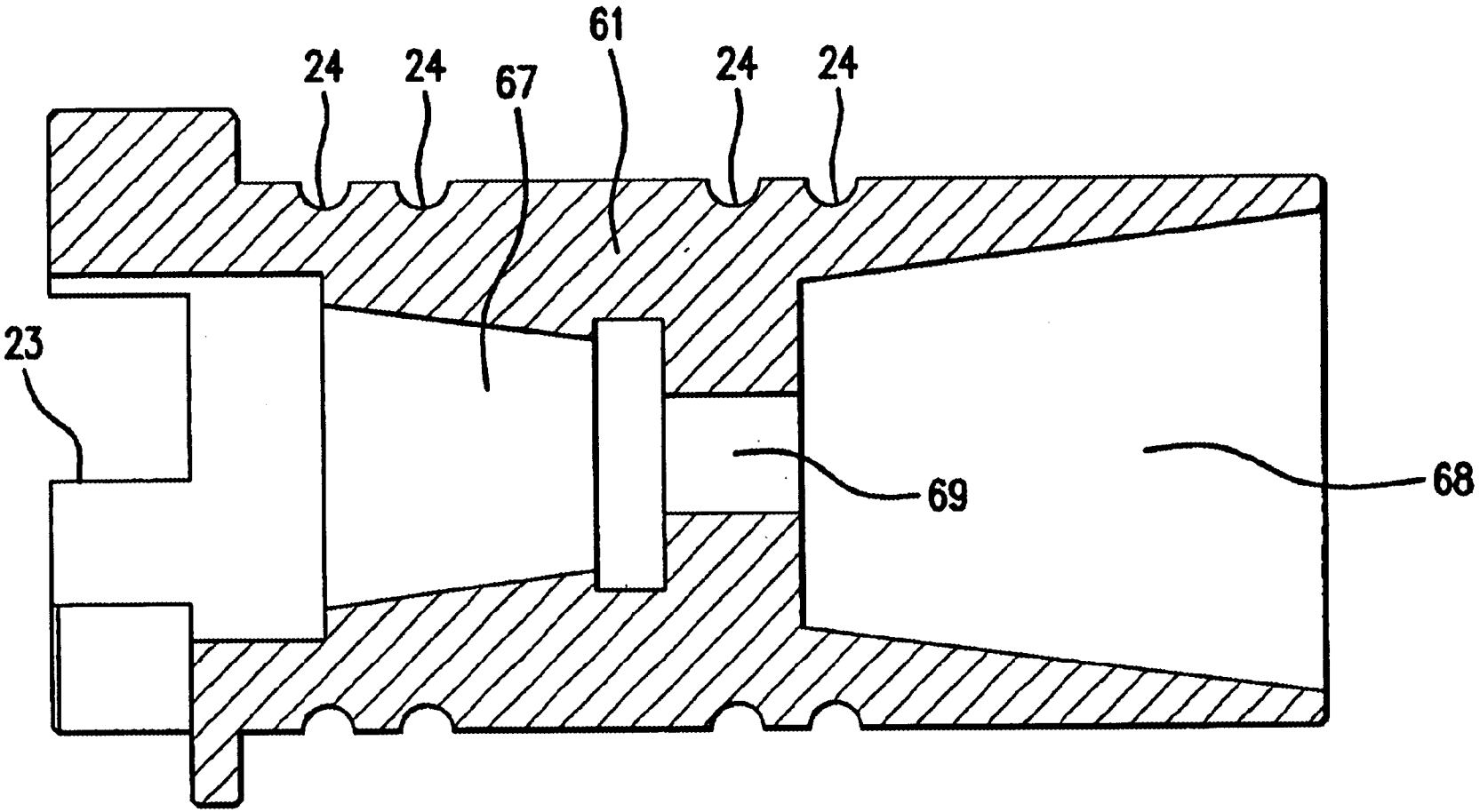
FIG. 15 is a cut-away view of the front inner core.

With reference now to FIG. 11, the front subassembly 60 is illustrated. The front subassembly 60 is comprised of a front inner core 61, front outer sleeve 62, and fixed sleeve 63. The rearward portion of the front inner core 61 contains the notches or teeth of the forward segment 23 of the jaw clutch 8. Also at the rear side of the front inner core 61 is an enlarged cavity that is adapted to receive a forward end of the drive shaft 4 and serve as a front drive shaft coupling 67. As with the rear subassembly 40, the means for engagement of the drive shaft 4 may be any convenient engagement means that may maintain a secure engagement during rotation of the drive shaft 4, but threaded engagement is preferred. The front side of the front inner core 61 also contains an enlarged cavity that is adapted to receive the rearward portion of the drill bit 10 and serve as a drill bit coupling 68. The drill bit coupling 68 preferably employs threaded means for engaging the drill bit 10. A front subassembly fluid cavity 69 is formed between the front drive shaft coupling 67 and the drill bit coupling 68 to provide for the transmission of drilling fluid from the drilling fluid passageway 50 to the drill bit 10. The exterior wall of the front inner core 61 has a plurality of bearing races 24 integrally formed therein, and corresponding bearing races 24 are integrally formed in the inner wall of the front outer sleeve 62. The front outer sleeve 62 is disposed around the front inner core 61 beginning at the rearward portion of the front inner core 61, but does not extend the entire length of the front inner core to completely cover it. A fixed sleeve 63 is positioned forward of the front outer sleeve 62 and is securely fastened by welding or other means to front inner core 61. As a result of this configuration, the front outer sleeve 62 may spin freely about the front inner core 61 on the plurality of radial bearings 65 positioned in the bearing races 24 correspondingly formed in each component. As with the rear subassembly 40, ball bearings are preferred. Bearing seals 64 are located near the front and rear inner wall of the front outer sleeve 62 to retain grease and prevent the infusion of drilling fluid and debris into the bearing races. In the preferred embodiment grease fittings are provided in the front subassembly 60 to allow lubrication of the radial bearings 65.

As observed at the rear of the offset transmitter housing 3, a seal cover is also located at the front. Like the rear seal cover 13, the front seal cover 14 is circumferential and may be either machined as an integral part of the offset transmitter housing 3 or made separately and welded or bolted into place. The welded method is, again, preferred. Positioned in the forward portion of the interior wall of the front seal cover 14 is the front seal 16. The front seal 16 is made of elastic material of sufficient stiffness so as to frictionally prevent unwanted rotation of the front outer sleeve 62 during actual downhole drilling operations, and it also serves to prevent cuttings and debris from entering into the drive shaft cavity 20. As with the rear assembly 40, small amounts of unwanted rotational torque play upon the front outer sleeve 62 as a result of its contact with the radial bearings 65 and the bearing seals 64. In actual operation when engaged in forward drilling, the rearward portion of the front outer sleeve 62 does not pass beyond the front seal 16. When forward drilling is progressing, the front outer sleeve 62 remains stationary and is positioned approximately as shown in FIG. 1. As forward drilling operations proceed, the primary forward thrust is transferred directly from the drive shaft 4 to the front inner core 61 by way of the front drive shaft coupling 67 and then transferred to the drill bit 10 by way of the drill bit coupling 68.

In its preferred embodiment, on the inner wall of the front seal cover 14, immediately rearward of the front seal 16, there is located a forward flange 70. As preferred, the forward flange 70 is created upon the machining of the front seal cover 14, and is positioned so that it is located equal distance from the radial bearings 65 when the front subassembly is forwardly extended during the drilling operation. The forward flange 70 serves to decrease the gap between the interior wall of the front seal cover 14 and the exterior wall of the front outer sleeve 62. In so doing the forward flange 70 serves four purposes. First, in actual drilling operations, there is constant stress that acts to apply radial load to the drill bit 10 and front subassembly 60. The forward flange 70 reduces the play of the front subassembly 60 by operating as a ledge against which the front outer sleeve 62 comes into contact as drilling is proceeding. The second function of the forward flange 70 in its positioning in relation to the radial bearings 65 is to extend the life of the radial bearings 65 by acting as a point of contact to center the radial load between the bearing races 24 in which the radial bearings 65 are located. A third function of the forward flange 70 is to aid in positioning the moving parts of the underground directional drilling tool 1 away from the wall of the borehole. The fourth function of the forward flange 70 is to assist the front seal 16 in providing frictional grip on the front outer sleeve 62 to thereby prevent the unwanted rotation of the sleeve.

As preferred, a rearward flange 71 is located on the inner wall of the rear seal cover 13. As with the forward flange 70, the rearward flange 71 is machined as an integral part of the rear seal cover 13, and is positioned so as to be centered between the radial bearings 46 when forward drilling is occurring. The rearward flange 71 accomplishes much the same four functions as are accomplished with the forward flange 70.

Having thus described the invention in connection with the preferred embodiments thereof, it will be evident to those skilled in the art that various revisions can be made to the preferred embodiments described herein without departing from the spirit and scope of the invention. It is our intention, however, that all such revisions and modifications that are evident to those skilled in the art will be included within the scope of the following claims.

What is claimed is:

1. A rear subassembly for use in a drilling apparatus having a directional control for boring or cutting a hole beneath the surface of the ground, said rear subassembly comprising:

a rear outer sleeve having an outer surface and further having an inner surface defining a continuous opening;

a rear inner core having an outer surface and further having an inner surface defining the rear connection point and a front connect point, said rear inner core disposed within the continuous opening in the rear outer sleeve thereby defining an interface between the outer surface of the rear inner core and the inner surface of the rear outer sleeve, with said rear inner core allowed to spin freely within the continuous opening of the rear outer sleeve; and a means for connecting the rear inner core to the rear outer sleeve.

2. The rear subassembly of claim 1 having a means to retain the rear outer sleeve in a stationary position as the rear inner core rotates freely within the continuous opening.

3. The rear subassembly of claim 1 wherein bearings are positioned at the interface of the rear inner core and rear outer sleeve.

4. The rear subassembly of claim 3 wherein at least a bearing race is defined by the interface between the outer surface of the rear inner core and the inner surface of the rear outer sleeve and further having bearings disposed within said bearing race.

5. A front subassembly for use with a drilling apparatus having a directional control for boring or cutting a hole beneath the surface of the ground, said front subassembly comprising:

a front outer sleeve having an outer surface and further having an inner surface defining a continuous opening;

a front inner core having an outer surface and further having an inner surface defining the rear connection point and a front connection point, said front inner core disposed within the continuous opening in the front outer sleeve thereby defining an interface between the outer surface of the front inner core and the inner surface of the front outer sleeve, with said front inner core allowed to spin freely within the continuous opening of the front outer sleeve; and a means for connecting the front outer sleeve to the front inner core.

6. The front subassembly of claim 5 having a means to retain the front outer sleeve in a stationary position as the front inner core rotates freely within the continuous opening.

7. The front subassembly of claim 5 wherein bearings are positioned at the interface of the front inner core and front outer sleeve.

8. The front subassembly of claim 7 wherein at least a bearing race is defined by the interface between the outer surface of the front inner core and the inner surface of the front outer sleeve and further having bearings disposed within said bearing race.

9. A drilling apparatus having a directional control for boring or cutting a hole beneath the surface of the ground which creates debris wherein the apparatus has a housing that rides or floats on the front and rear subassemblies, said apparatus comprising:

a drive shaft rotatable about a central axis;

a rear subassembly having a front end and a rear end, further comprised of a rear inner core disposed within and rotatably independent from a rear outer sleeve positioned at the front end, said rear inner core having a rear end defining a rear connection point and a forward end defining a front connection point;

a front subassembly having a front end and a rear end, further comprised of a front inner core disposed within and rotatably independent from a front outer sleeve positioned at the rear end, said front inner core having a rear end defining a rear connection point and a forward end defining a front connect point;

an offset transmitter housing having an elongated drive shaft cavity through which the drive shaft passes, said offset transmitter housing having a front, a rear, a first side, and a second side, the first side being positioned closer to the central axis of the drive shaft than the second side, further said offset transmitter housing having a rear connection point defining an opening for receiving the rear outer sleeve of the rear subassembly and means for retaining said rear outer sleeve in a stationary position and having a front connection point defining an opening for receiving the front outer sleeve of the front subassembly and means for retaining said front outer sleeve in a stationary position;

the drive shaft having a front connection point extending from the front of the offset transmitter housing operatively connected to the rear connection point of the front subassembly and a rear connection point extending from the rear of the offset transmitter housing operatively connected to the front connection point of the rear subassembly;

a drill bit operatively connected to the front connection point of the front subassembly for creating a borehole;

power means for rotating the drive shaft operatively connected to the rear connection point of the rear subassembly;

transmitting means combined with the offset transmitter housing for sending information to the surface of the ground pertaining to the position, direction, orientation and inclination of the offset transmitter housing;

means for controllably changing the orientation of the first and second side of the offset transmitter housing while the apparatus is within the bore hole;

means for retaining the offset transmitter housing in a selected position of orientation within the bore hole comprised of at least a stationary stabilizing fin affixed to the exterior of the offset transmitter housing near its front on the second side of said housing; and means for conveying drilling fluid from the surface of the ground to the drill bit.

* * * * *